United States Patent [19]

Gloaguen

[11] 4,287,467

[45] Sep. 1, 1981

[54] CONSTANT-VOLTAGE GENERATOR FOR INTEGRATED CIRCUITS

[75] Inventor: Gilbert Y. M. Gloaguen, Caen, France

[73] Assignee: U.S. Philips Corporation, New York, N.Y.

[21] Appl. No.: 140,943

[22] Filed: Apr. 16, 1980

[30] Foreign Application Priority Data

Apr. 20, 1979 [FR] France ..... 79 10085

[51] Int. Cl.[3] ..... G05F 3/20

[52] U.S. Cl. ..... 323/314; 323/907

[58] Field of Search ..... 323/1, 4, 19; 307/296 R, 297

[56] References Cited

U.S. PATENT DOCUMENTS 3,781,648 12/1973 Owens ..... 323/4

4,061,959 12/1977 Ahmed ..... 323/19 X 4,085,359 4/1978 Ahmed ..... 323/19 X 4,177,416 12/1979 Davis ..... 323/4

*Primary Examiner*—A. D. Pellinen

*Attorney, Agent, or Firm*—William J. Streeter; Bernard Franzblau

[57] ABSTRACT

A constant voltage generator includes means for compensating for deviations of its output voltage that are due to variations in the supply voltage or changes in ambient temperature. The generator features a negative feedback resistor connected in the emitter circuit of a transistor between whose emitter and collector branches said output voltage appears. A current flows through this resistor which is supplied by another transistor whose current varies as a function of supply voltage variations. The generator may be used for supplying bias voltages to logic circuits.

12 Claims, 1 Drawing Figure

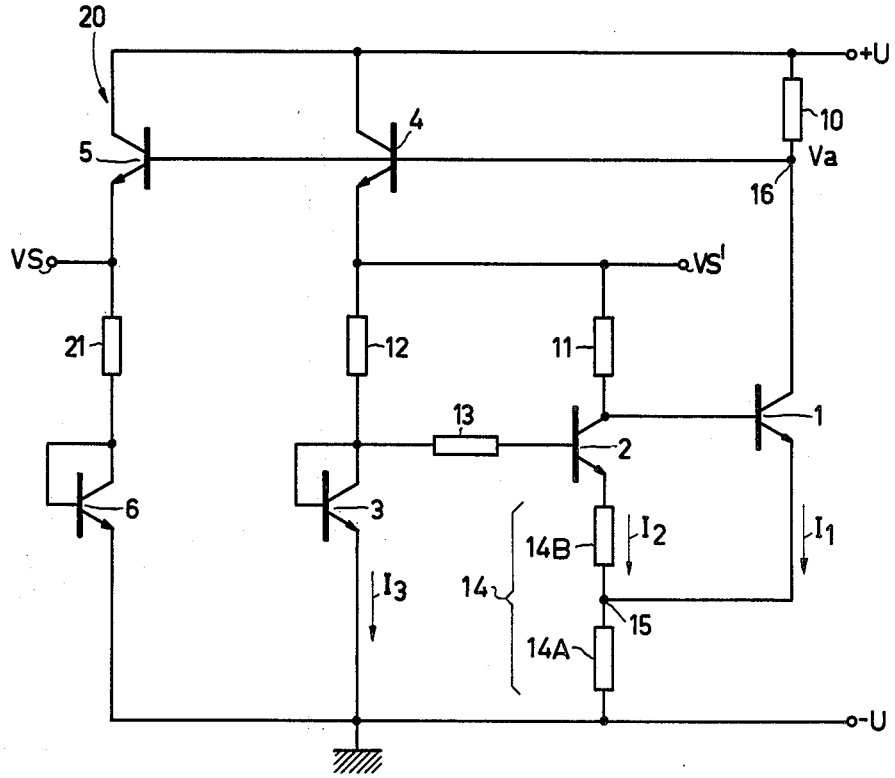
20
+U
10
Va
16
5
4
VS
VS'
21
12
11
13
1
2
6
3
14B
I2
I1
14
I3
15
14A
-U

CONSTANT-VOLTAGE GENERATOR FOR INTEGRATED CIRCUITS

The invention relates to a constant-voltage generator for integrated circuits, more particularly to a generator that comprises a first transistor having a collector that is coupled via a coupling network to the base of a second transistor which drives said first transistor, said network comprising a diode in its parallel branch and a first resistor in its series branch, and a second resistor that is connected in series with the emitter of the second transistor.

The invention particularly relates to a generator which is adapted to supply the bias voltage required for the operation of differential amplifiers used in logic circuits which are known as E.C.L. circuits (emitter-coupled logic).

In integrated logic circuits, and in particular in E.C.L. circuits, it is necessary that the levels of the various voltages (input and output voltage, bias voltage) are well-defined and stable in spite of various causes which may give rise to variations therein (for example supply-voltage variations and/or variations in characteristics of the components as a result of changes in ambient temperature). A good stability is necessary in order to ensure that the logic circuit responds correctly to the drive and load circuits connected to it and has a satisfactory noise immunity.

In the past numerous voltage generators or regulators for integrated circuits have been designed in which, by means of a variety of suitable correction circuits, it has been attempted to mitigate the effects of various factors affecting the stability of the bias voltage supplied. Depending on the type of generator more or less allowance is made for some deviation factor: in most cases the effects of ambient-temperature variations and/or the effects of supply-voltage variations are to be corrected.

Amongst the known circuits the voltage regulator described in U.S. Pat. No. 3,781,648 deserves attention. When designing this generator attention was paid mainly to the gain factor $\beta$ and the base current $I_B$ of the transistors of which it is constituted. Indeed said parameters, $\beta$ and $I_B$, may differ and vary to a different extent among in principle identical transistors used in integrated regulators which themselves are in principle identical, even if said regulators have been manufactured simultaneously starting from the same basic material. If no allowance was made for this, this would give rise to differences from regulator to regulator in respect of the value of the supplied bias voltage -or reference voltage.

The voltage regulator in accordance with said United States patent essentially comprises two transistors. Via its collector the first of these transistors, i.e. the output transistor, designated $Q_3$ in the Figures, at whose emitter the reference voltage is available, is degeneratively coupled to the base of the second or driver transistor $Q_2$. The feedback circuit is a T-network, which comprises two resistors $R_2$ and $R_x$ in its horizontal branch, included between the collector of the first transistor and the base of the second transistor, and a diode $Q_1$ included in its vertical branch. The resistor, $R_x$, of said two resistors which is situated near the base of the second transistor, specifically compensates for variations of the base-emitter voltage of the first transistor $Q_3$ and variations of the base-currents of the transistors $Q_2$ and $Q_3$, as is explained in the text of said patent by means of algebraic formulas.

Said voltage regulator, which is advantageous because it comprises a simple means for mitigating reference voltage deviations as a result of manufacturing tolerances, unfortunately has the drawback that it does not sufficiently allow for the influence of supply voltage variations.

Furthermore, as is corroborated by calculations and experience, the correction of deviations of the reference voltage as a result of variations of the $\beta$ of the transistors leads to realizing the resistor $R_x$ as a non-pinched resistor, in such a way that it remains constant and does not vary in the same sense as $\beta$. However, calculations and experience also show tht deviations of said reference voltage owing to temperature variations are not effectively compensated for if the resistor $R_x$ is of the pinched type. Thus, there is an incompatibility with respect to the circuit requirements.

The constant-voltage generator in accordance with the present invention mitigates this incompatibility problem. It provides a simple means by which the bias voltage supplied by said generator is made substantially independent of the supply voltage.

A voltage generator as defined in the preamble of the present text is characterized in that the emitter of said first transistor is connected to a tapping on said second resistor.

The bias voltage supplied by the generator in accordance with the invention is equivalent to that appearing between the output of a load resistor in the collector circuit of the second transistor and ground of the device, to which the end of the second resistor is connected.

The value of said bias voltage, as will become apparent from the circuit diagram, is substantially equal to the sum of the voltage between the base and the emitter of the first transistor and the voltage across said load between the emitter and base of the first transistor will vary in the same sense and so will the current in the emitter of said transistor.

According to the invention the emitter current of the first transistor also flows through the part of said second resistor between the tapping provided on said resistor and ground. This results in a negative feedback in the emitter of the second transistor which causes a variation of the voltage across the load resistor in the collector circuit of said transistor, which variation is opposed to that appearing between the emitter and the base of the first transistor.

By a suitable choice of the values of the resistors used, the two variations, i.e. the variation of the base-emitter voltage of the first transistor and the voltage across said load resistor, will cancel each other in the most favourable case, thus reducing the amplitude of bias voltage deviations as a result of supply voltage variations. In practice the use of the steps in accordance with the invention enables said amplitude to be reduced to a quarter of the value measured on a similar generator which has not been modified in accordance with the invention.

For this purpose it is necessary that the total value of said second resistor be several times higher than that of the part of said resistor which is common to the emitter circuits of the first and the second transistor.

Suitably, the corresponding ratio should lie between 10 and 16.

A further advantage of the invention is that it contributes to a better compensation for bias-voltage deviations as a result of temperature variations. Indeed, in the loop formed by said diode, said first resistor, the base-emitter path of the second transistor and said second resistor, the part of the last-mentioned resistor which is common to the emitter circuits of the first and the second transistor introduces a certain temperature compensation for the spurious component constituted by the resistance of said diode. Previously, said spurious component had to be compensated for by the first resistor, which made it necessary, as is demonstrated by the calculations, to realize this first resistor as a pinched resistor. Owing to the invention the first resistor can be realized in a simple form, i.e. non-pinched, which provides a more effective compensation of bias-voltage variations as a result of manufacturing tolerances.

The advantages of the invention mentioned in the foregoing will become more apparent from the following description with reference to the accompanying drawing.

The sole FIGURE of the drawing represents the partial circuit diagram of a constant voltage generator for integrated circuits improved in accordance with the invention.

The generator is intended to supply a stabilized bias voltage from a terminal designated VS to an external integrated circuit, for example an ECL logic circuit. It is known that for the operation of an ECL circuit there are generally provided two bias voltage outputs. Since the invention relates to the actual stabilizing section of the generator, the second bias voltage output and the associated part of the circuit are not shown in the diagram in order to simplify the drawing.

The generator is connected between the two terminals +U and −U (the latter being the ground of the device) of a power-supply source.

Said generator comprises three NPN transistors 1, 2 and 3, the transistors 1 and 2 being those referred to in the foregoing as the first and the second transistor.

The base of the transistor 1 is connected directly to the collector of transistor 2 and its collector is connected to the power supply terminal +U via a resistor 10. Furthermore, via the base-emitter path of a fourth NPN type transistor 4 (whose collector is connected to +U), the collector of said transistor 1 is connected to the collector of transistor 2 by the resistor 11 and to the base of the transistor 2 via two resistors 12 and 13 which are connected in series (the resistor 13 is that one which in the foregoing has been referred to as the first resistor).

Transistor 2 has its emitter connected to the power supply terminal −U via a resistor 14 (in the foregoing referred to as: second resistor).

Transistor 3, whose base and collector are short-circuited (thus constituting the diode mentioned in the foregoing), is connected in the forward direction between the common point of the resistors 12 and 13 and the power-supply terminal −U.

It is in this part of the generator, which includes the transistors 1, 2 and 3, described in the foregoing, that the bias voltage VS supplied by said generator is stabilized.

The voltage output VS is included in a branch 20 of the circuit which, starting from the terminal +U, includes an NPN transistor 5, similar to transistor 4 and connected in a similar manner, a resistor 21 and an NPN transistor 6 connected as a diode. The output VS is connected to the junction point of the emitter of transistor 5 and the resistor 21 and, via transistor 5, which is connected as an emitter-follower and which serves as a buffer for driving the emitters of the ECL ports, it forms the counter-part of an output VS′, which is a ficticious output which only occurs in the present description for the sake of convenience, included in the common line between the emitter of the transistor 4 and the resistors 11 and 12.

The bias voltages supplied by the generator are stabilized directly by stabilizing the voltage VS′. This stabilization is automatically followed by the voltage VS.

According to the invention, a constant-voltage generator for integrated circuits comprises, a first transistor 1 having a collector coupled via a coupling network to the base of a second transistor 2 which drives said first transistor 1, said network comprising a diode 3 connected between a first point and a second point (ground) and a first resistor 13 connected between said first point and the base of the second transistor 2, a second resistor 14 connected between the emitter of the second transistor and the second point, and wherein the emitter of said first transistor 1 is connected to a tapping 15 provided on said second resistor 14.

Furthermore, in accordance with the invention, the total value of said second resistor 14 is several times higher than that of the part 14A of said resistor which is common to the emitter circuits of the first and the second transistor.

The corresponding ratio, i.e. the ratio of the sum of the resistance values of the parts 14A and 14B, which together constitute the resistor 14, to the resistance value of the part 14A, suitably lies between 10 and 16.

The part 14A of the resistor 14 introduces a negative feedback component in the emitter circuit of the transistor 2. The main function of said part 14A is to compensate for deviations of the voltage VS′ (and consequently of the bias voltage VS) as a result of variations of the supply voltage U.

For a better understanding of the favourable effect of the part 14A of the resistor 14, it is necessary to examine the situation in which said resistance element is not present, i.e. the situation in accordance with the prior art in which the emitter circuit of the transistor 1 is connected directly to −U and in which there is nevertheless a resistance in the emitter circuit of the transistor 2.

When—for example—the supply voltage U increases (it is assumed that the potential of the terminal −U, which is connected to ground, is stable and that variations appear on the terminal +U), this has a direct influence, via the resistor 10, on the potential Va at point 16 at the end of this resistor. This increase also directly influences the base-emitter voltage $VBE_1$ of the transistor 1 via the base-emitter path of transistor 4 and the resistor 11. This leads to an increase of the base current IB of the transistor 1, of the current $I_1$ flowing in the collector and in the emitter (except for the value of $IB_1$) of said transistor 1, of the voltage drop $r_{10}I_1$ across the resistor 10, and thus to a decrease of the potential Va.

The voltage VS′ is partly stabilized because the variation of Va caused by U is partly compensated for by that caused by $r_{10}I_1$. However, a measurement reveals that a residual deviation of VS′ of approximately 30 mV per volt variation of U may occur. Such a deviation of VS′ is at variance with the operating requirements for ECL circuits.

When the causes of the residual deviation of VS' as a result of supply voltage variations are analyzed, this reveals that it is substantially impossible to reduce said deviation by means of the prior-art circuit.

If the emitter of the transistor 1 is connected directly to ground:

$$VS' = VBE_1 + V_{11}$$

($V_{11}$ being the voltage across resistor 11).

A first cause of the residual deviation of VS' is the variation of $VBE_1$.

Let the variation $\Delta U$ of the supply voltage U be $\Delta U = U_2 - U_1$.

As the potential Va at point 16 is substantially stabilized at its initial value, this yields:

$$\Delta VBE_1 = \frac{KT}{q} L_n \frac{I_{12}}{I_{11}} \quad (1)$$

($I_{12}$: the current $I_1$ corresponding to the supply voltage $U_2$)

($I_{11}$: the current $I_1$ corresponding to the supply voltage $U_1$)

while:

$$I_{12} = \frac{U_2 - Va}{r_{10}}, \quad I_{11} = \frac{U_1 - Va}{r_{10}}$$

($r_{10}$: value of the resistor 10)

Substituting the foregoing values of $I_{12}$ and $I_{11}$ in expression (1) yields:

$$\Delta VBE_1 = \frac{KT}{q} L_n \frac{U_2 - Va}{U_1 - Va} \quad (2)$$

It follows from expression (2) that the deviation from the value of VS' caused by the factor $\Delta VBE_1$ cannot be influenced directly.

A second cause of the residual deviation of VS' is the variation of $V_{11}$.

This variation $\Delta V_{11}$ is caused by the variation $\Delta IB_1$ of the base current of transistor 1 as a result of the variation of U.

$$\Delta V_{11} = r_{11} \cdot \Delta IB_1 = r_{11} \cdot \frac{\Delta I_1}{\beta_1} = r_{11} \cdot \frac{U_2 - U_1}{\beta_1 \cdot r_{10}} \quad (3)$$

($\beta_1$: gain factor of transistor 1) ($r_{11}$: value of resistor 11).

In accordance with expression (3) $\Delta V_{11}$ can be reduced only by increasing $r_{10}$, $r_{11}$ being related to the values of the resistors 13 and 14. However, this is of little avail, for if the value of the resistor 10 would be too high, the share of the base currents $IB_4$ and $IB_5$ in the current through said resistor 10 would become comparatively large (while in fact it is negligible) and consequently a very poor stabilization of VS' would be obtained.

A third comparatively less significant cause of the residual deviation of VS' is related to variations of the resistive voltage drops across the stray emitter resistance $rE_1$ and stray base resistance $rB_1$ of transistor 1. These variations act in the same direction and their sum may be expressed as:

$$rE_1 \cdot \Delta I_1 + rB_1 \cdot \Delta IB_1 = rE_1 + \frac{rB_1}{\beta_1} \frac{U_2 - U_1}{r_{10}} \quad (4)$$

In order to reduce the term (4) of the deviation, it is only possible to influence $r_{10}$. However, it has already been demonstrated that this is hardly possible. It might also be considered to increase the dimensions of the transistor 1 in such a way that $rE_1$ and $rB_1$ are reduced. However, the dimensions of transistor 1 are related to those of transistors 2 and 3 for reasons of temperature compensation.

The addition of a resistance element 14A in a common part of the emitter circuits of the transistors 1 and 2, as proposed by the invention, provides a substantial reduction of the influence of residual variations of VS' owing to supply voltage deviations.

In the expression for VS' the addition of the resistive element 14A results in a term $r_{14A}(I_1 + I_2)$, $I_2$ being the current in the collector-emitter circuit of the transistor 2.

Thus, a variation $\Delta VS'$ of the bias voltage VS' is resolved as follows:

$$\Delta VS' = \underbrace{\Delta VBE_1}_{(2)} + \underbrace{\Delta V_{11}}_{(3)} + \underbrace{(rE_1 \cdot \Delta I_1 + rB_1 \cdot \Delta IB_1)}_{(4)} + \underbrace{r_{14A}(\Delta I_1 + \Delta I_2)}_{(5)}$$

The variation $\Delta I_1$ caused by a deviation $\Delta U$ of the supply voltage U is incomparably greater than the variation $\Delta I_2$ caused by said deviation $\Delta U$ itself. Furthermore, in the term (5) $\Delta I_2$ can be eliminated more easily as $r_{14A}$ is made smaller.

For example, in the case of a positive variation $\Delta U$, the terms (2) and (4) will vary in a positive sense. Initially, the term (3) also varies in a positive sense.

The equally positive variation $r_{14A} \cdot \Delta I_1$ of the term (5), however, results in a decrease of the voltage $VBE_2$ of transistor 2, and thus of $I_2$ of this transistor $$\left( \Delta I_2 = -\Delta I_1 \cdot \frac{r_{14A}}{r_{14A} + r_{14B}} \right).$$

The variation $\Delta I_2$ causes a variation $r_{11} \cdot \Delta I_2$ in the negative sense of $V_{11}$, which variation, if the values of the resistor 11 and the parts 14A and 14B of the resistor 14 have been selected correctly, suffices to compensate for the aforementioned combination of variations in a positive sense of the terms constituting $\Delta VS'$.

On the other hand, as is apparent from the foregoing, the resistance part 14A not only compensates for deviations of the supply voltage U, but also has a favourable effect, which is complementary to that of the resistor 13, in respect of the compensation for temperature effects.

More precisely, it is to be noted that in the loop constituted by the transistor 3, which is connected as a diode, the resistor 13, the base-emitter path of transistor 2 and the second resistor 14, the potential difference $r_{14A} \cdot I_1$ is opposed to the potential difference $rE_3 \cdot I_3$ caused by a current $I_3$ in the emitter resistance $rE_3$ of the transistor 3. The term $rE_3 \cdot I_3$ is comparatively significant because the temperature compensation of the complete circuit demands that the current density in the transistor 3 should be distinctly higher than that in the transistor 2. Thus, the transistor 3 is a "small" transistor whose emitter resistance is consequently high and through which, moreover, a comparatively large current flows, which causes a substantial voltage drop $rE_3 \cdot I_3$.

In the absence of the resistor 14A, the compensation for the effect of $rE_3$ should be provided by the resistor 13. Such a long calculation, which falls beyond the scope of the invention and which for this reason has not been included in the present text, reveals that in order to obtain a correct compensation for $rE_3 \cdot I_3$, the resistor 13 should take the form of a pinched resistor. However, it furthermore appears that in order to obtain a correct compensation for variations of $\beta$ owing to manufacturing tolerances, the resistor 13 should be of the non-pinched type.

The introduction of the potential difference $r_{14A} \cdot I_1$, which is opposed to the potential difference $rE_3 \cdot I_3$, enables the role of compensating for the stray emitter resistance $rE_3$ to be transferred at least partly from the resistor 13 to the resistor 14A.

Consequently, the resistor 13 can be of the non-pinched type so that a more effective $\beta$-compensation can be obtained.

Thus, all resistors of the generator are of the non-pinched type.

The manufacture of a constant-voltage generator in accordance with the invention in integrated form poses no special problems. Particularly the realization of the resistor 14 presents no difficulty. Owing to the great difference in value between the parts 14A and 14B of said resistor, it is in practice constituted by two elements connected in series. The two elements are realized simultaneously, at the same time as the other elements of the circuit, for example, the other resistors of said circuit.

It is to be noted that the area of a semiconductor chip occupied by a generator in accordance with the invention comprising a resistor 14A is not greater than that required for a generator of a similar structure which does not include this feature.

Without modifying the diagram a generator in accordance with the invention may be used for supplying a stabilized bias voltage to any integrated circuit. In any case it suffices to adapt the power ratings and the values of the components. Owing to the high stability of the voltage which is supplied, this generator is particularly suitable for the supply of power to ECL circuits. By way of indication the values of the voltages, currents and resistors are given hereinafter which characterize a generator which is adapted to supply a bias voltage of 1.32 V±10 mV to an ECL circuit requiring a current between 1 and 2 mA.

| | |
|---|---|
| U = 4.5 V | (4.2 to 5.2 V) |
| $I_1$ = 0.60 mA | (0.40 to 1 mA) |
| $I_2$ = 0.40 mA | (0.30 to 0.80 mA) |
| $I_3$ = 2 mA | (1.5 to 4 mA) |
| Resistor 10 : | 3900Ω(2300 to 6000Ω) |
| Resistor 11 : | 1300Ω(650 to 1700Ω) |
| Resistor 12 : | 260Ω(130 to 350Ω) |
| Resistor 13 : | 205Ω(100 to 400Ω) |
| Resistor 14A: | 12Ω(7 to 16Ω) |
| Resistor 14B | 160Ω(90 to 130Ω) |

What is claimed is:

1. A constant voltage generator for integrated circuits comprising, first and second transistors each having emitter, collector and base electrodes, means coupling the collector of the second transistor to the base of the first transistor, a coupling network coupling the collector of the first transistor to the base of the second transistor, said coupling network comprising a first resistor connected between a first circuit point and the base of the second transistor and a diode connected between said first point and a second circuit point, a second resistor connected between the emitter of the second transistor and the second point, and means connecting a tap point on the second resistor to the emitter of the first transistor.

2. A voltage generator as claimed in claim 1 wherein the total resistance value of said second resistor is several times higher than that of the part of said resistor which is common to the emitter circuits of the first and the second transistor.

3. A voltage generator as claimed in claim 2, characterized in that the ratio of the total resistance to the resistance of said part of the second resistor lies in the range between 10 and 16.

4. A voltage generator as claimed in any of the preceding claims, characterized in that said second resistor comprises two separate resistor elements connected in series.

5. A voltage generator as claimed in claim 1, 2 or 3 wherein all of the resistors necessary to realize said voltage generator are of the non-pinched type.

6. A voltage generator as claimed in claim 1 further comprising first and second terminals coupled to the voltage generator for supplying dc operating voltages thereto and of a polarity to forward bias said diode.

7. A voltage generator as claimed in claim 1 or 6 wherein said first and second transistors are of the same conductivity type and the diode comprises a transistor also of the same conductivity type with its collector directly connected to its base to form said diode.

8. A voltage regulator circuit comprising, first and second terminals for receiving operating voltages for the circuit, an output terminal for supplying a stabilized voltage independent of the operating voltages and ambient temperature, first and second transistors each having emitter, collector and base electrodes, a diode, first means coupling the collector of the second transistor to the base of the first transistor, a coupling network including a first resistor for coupling the collector of the first transistor to the base of the second transistor, first means connecting said diode in series with the first resistor between the second terminal and the base of the second transistor, a second resistor connected between the emitter of the second transistor and the second terminal thereby forming an emitter circuit for the second transistor, second means coupling the collector of the first transistor to said first terminal and to said output terminal, and second means connecting the emitter of the first transistor to the emitter circuit of the second transistor so as to produce a negative feedback component in said emitter circuit of the second transistor.

9. A voltage regulator circuit as claimed in claim 8 wherein the coupling network includes a third resistor connected between the collector of the first transistor and a junction point between the first resistor and the diode and said second coupling means includes a fourth resistor connecting the first terminal to the collector of the first transistor and to the output terminal.

10. A voltage regulator as claimed in claim 8 or 9 wherein the first coupling means provides a direct connection between the collector of the second transistor and the base of the first transistor and wherein the second connecting means connects the emitter of the first transistor to a tap point on the second resistor.

11. A voltage regulator circuit as claimed in claim 10 wherein the diode is connected so as to be forward biased by operating voltages appearing at the first and second terminals, and wherein the circuit further comprises a fifth resistor connecting the collector of the second transistor to the collector of the first transistor.

12. A voltage regulator circuit as claimed in claim 8 or 9 wherein the circuit further comprises a fifth resistor connecting the collector of the second transistor to the collector of the first transistor.

* * * * *